US008337222B2

(12) United States Patent
Hung et al.

(10) Patent No.: US 8,337,222 B2
(45) Date of Patent: Dec. 25, 2012

(54) CONNECTOR SOCKET AND PORTABLE ELECTRONIC DEVICE USING THE SAME

(75) Inventors: Shih-Wei Hung, Taipei (TW); Xiao Ye, Shanghai (CN)

(73) Assignees: Pegatron Corporation, Taipei (TW); Pretek (Shanghai) Limited, Shanghai (CN)

( * ) Notice: Subject to any disclaimer, the term of this patent is extended or adjusted under 35 U.S.C. 154(b) by 348 days.

(21) Appl. No.: 12/719,054

(22) Filed: Mar. 8, 2010

(65) Prior Publication Data

US 2010/0248554 A1 Sep. 30, 2010

(30) Foreign Application Priority Data

Mar. 25, 2009 (TW) ..... 98109732 A

(51) Int. Cl.
*H01R 13/44* (2006.01)

(52) U.S. Cl. ..... 439/138

(58) Field of Classification Search ..... 439/138, 439/136, 137, 142, 144
See application file for complete search history.

(56) References Cited

U.S. PATENT DOCUMENTS

| | | | | |
|---|---|---|---|---|
| 4,847,711 | A * | 7/1989 | Inoue | 360/96.51 |
| 5,035,633 | A * | 7/1991 | Kobayashi et al. | 439/140 |
| 5,506,922 | A * | 4/1996 | Grois et al. | 385/75 |
| 5,694,290 | A * | 12/1997 | Chang | 361/679.31 |
| 6,004,043 | A * | 12/1999 | Abendschein et al. | 385/76 |
| 6,164,989 | A | 12/2000 | Glad et al. | |
| 6,247,849 | B1 * | 6/2001 | Liu | 385/55 |
| 6,375,480 | B1 * | 4/2002 | Chen et al. | 439/142 |
| 6,595,696 | B1 * | 7/2003 | Zellak | 385/72 |
| 6,832,920 | B2 * | 12/2004 | Glad et al. | 439/131 |
| 6,869,297 | B2 * | 3/2005 | Caveney | 439/138 |
| 6,971,921 | B1 | 12/2005 | Lai | |
| 7,357,653 | B2 * | 4/2008 | Hung et al. | 439/138 |
| 7,466,555 | B2 * | 12/2008 | Yamamoto | 361/737 |
| 7,534,115 | B2 * | 5/2009 | Murano et al. | 439/138 |
| 8,057,249 | B1 * | 11/2011 | Tobey et al. | 439/345 |

FOREIGN PATENT DOCUMENTS

| | | |
|---|---|---|
| CN | 1123477 A | 5/1996 |
| TW | 490102 | 6/2002 |
| TW | M253101 | 12/2004 |
| TW | M266598 | 6/2005 |

OTHER PUBLICATIONS

English translation of abstract of CN 1123477 A.
English abstract of TW 490102, pub. Jun. 1, 2002.
English abstract of TW M266598, pub. Jun. 1, 2005.
English translation of abstract of TW M253101 (Published Dec. 11, 2004).

* cited by examiner

*Primary Examiner* — Amy Cohen Johnson
*Assistant Examiner* — Vladimir Imas
(74) *Attorney, Agent, or Firm* — McClure, Qualey & Rodack, LLP

(57) ABSTRACT

This invention provides a connector socket and a portable electronic device using the same. The connector socket is disposed at a casing for connecting a connector. The connector socket includes a rotatable element and a biasing element. The rotatable element is pivotally connected to the casing. The biasing element is coupled to the casing and the rotatable element. The rotatable element has a protrudent portion. When the connector is connected to the connector socket, the connector presses the protrudent portion to allow the rotatable element to automatically rotate from a storage position to an open position. When the connector is separated from the connector socket, the rotatable element automatically rotates from the open position to the storage position via the biasing element.

17 Claims, 7 Drawing Sheets

CONNECTOR SOCKET AND PORTABLE ELECTRONIC DEVICE USING THE SAME

This Non-provisional application claims priority under 35 U.S.C. §119(a) on Patent Application No(s). 098109732 filed in Taiwan, Republic of China on Mar. 25, 2009, the entire contents of which are hereby incorporated by reference.

BACKGROUND OF THE INVENTION

1. Field of the Invention

This invention relates to a connector socket and, more particularly, to a connector socket and a portable electronic device using the same.

2. Description of the Related Art

With development of electronic technology, electronic devices with small volume and powerful functions attract more and more users. The electronic devices usually need signal cables for transferring power, data and so on. The signal cables are usually connected to the electronic devices by connectors. Therefore, connector sockets cooperating with the connectors are generally applied to the electronic devices. For example, an RJ45 connector socket for a network node is usually applied.

However, since the connector usually has a certain dimensional standard, the dimension of the connector socket is also limited.

FIG. 1 is a schematic diagram showing a conventional RJ45 connector socket of a notebook computer. In FIG. 1, a height of a connector socket 11 in a vertical direction is greater than a thickness of a lower casing 10 of a notebook computer 1 in the same direction. Therefore, as shown in FIG. 1, when the connector socket 11 is disposed at one side of the lower casing 10 of the notebook computer 1, the bottom of the connector socket 11 is protrudent from the notebook computer 1. Thus, the aesthetics of the notebook computer is deteriorated.

In addition, since the volume of the connector socket 11 is great, external substances, such as dust, are easy to enter into the interior of the notebook computer 1 through the connector socket 11, thereby damaging internal circuits of the notebook computer 1.

BRIEF SUMMARY OF THE INVENTION

One objective of this invention is to provide a connector socket and a portable electronic device using the same to improve the prior art.

According to one aspect of the invention, a connector socket disposed at a casing is provided for connecting to a connector. The connector socket includes a rotatable element and a biasing element. The rotatable element is pivotally connected to the casing and has a protrudent portion. The biasing element is coupled to the casing and the rotatable element. When the connector is connected to the connector socket, the connector presses the protrudent portion to allow the rotatable element to automatically rotate from a storage position to an open position. When the connector is separated from the connector socket, the rotatable element automatically rotates from the open position to the storage position via the biasing element.

According to another aspect of the invention, a portable electronic device is further provided for connecting a connector. The portable electronic device includes a casing and a connector socket. The casing has an opening, and the connector socket is disposed at the opening. The connector socket includes a rotatable element and a biasing element. The rotatable element is pivotally connected to the casing and has a protrudent portion. The biasing element is coupled to the casing and the rotatable element. When the connector is connected to the connector socket, the connector presses the protrudent portion to allow the rotatable element to automatically rotate from a storage position to an open position. When the connector is separated from the connector socket, the rotatable element automatically rotates from the open position to the storage position via the biasing element.

Via the connector socket in the invention, the volume of the connector socket can be reduced. When the connector is inserted, the rotatable element of the connector socket can automatically rotate to the open position. When the connector is pulled out, the rotatable element can automatically rotate to the storage position. In the two positions, the heights of the connector socket are different. Thus, electronic elements can be miniaturized. Further, when the connector socket is applied to the portable electronic device, the appearance of the portable electronic device can be ensured to have a streamlined effect before the connector is inserted, thus to meet consumers' needs for the appearance of the portable electronic device. In addition, compared with the connector socket with great volume in the prior art, the connector socket in the invention can further prevent external substances such as dust from entering into the interior of the portable electronic device.

These and other features, aspects, and advantages of the present invention will become better understood with regard to the following description, appended claims, and accompanying drawings.

DETAILED DESCRIPTION OF THE INVENTION

Figure 1:
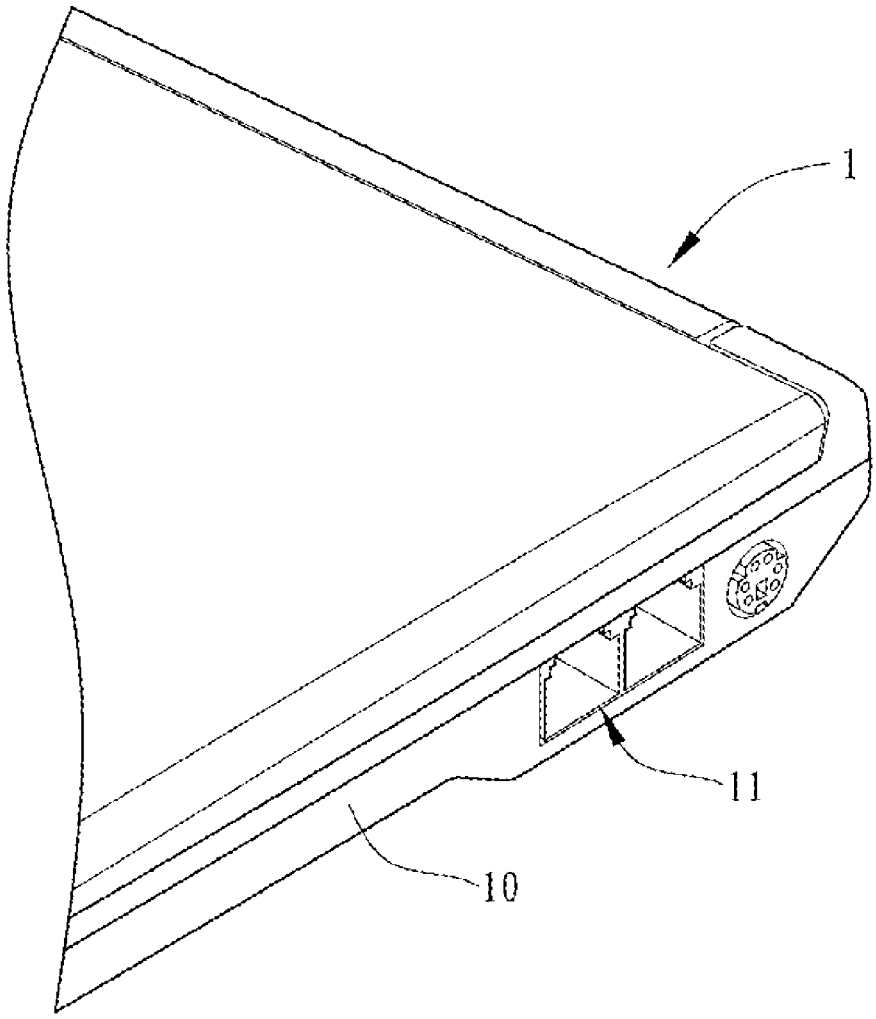
FIG. 1 (Prior Art)
FIG. 1 is a schematic diagram showing a conventional RJ45 connector socket of a notebook computer.
Figure 2:
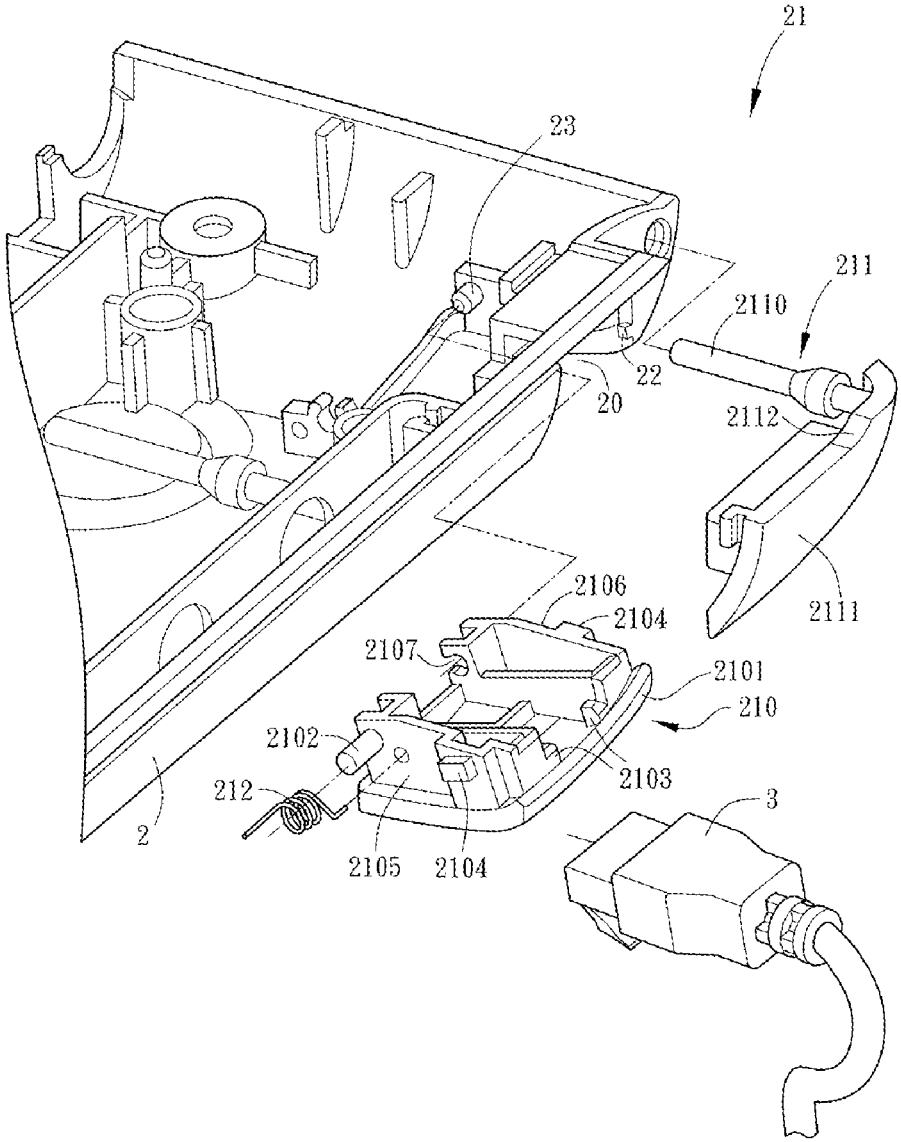
FIG. 2 is an exploded schematic diagram showing a connector socket according to one preferred embodiment of the invention.
Figure 3:
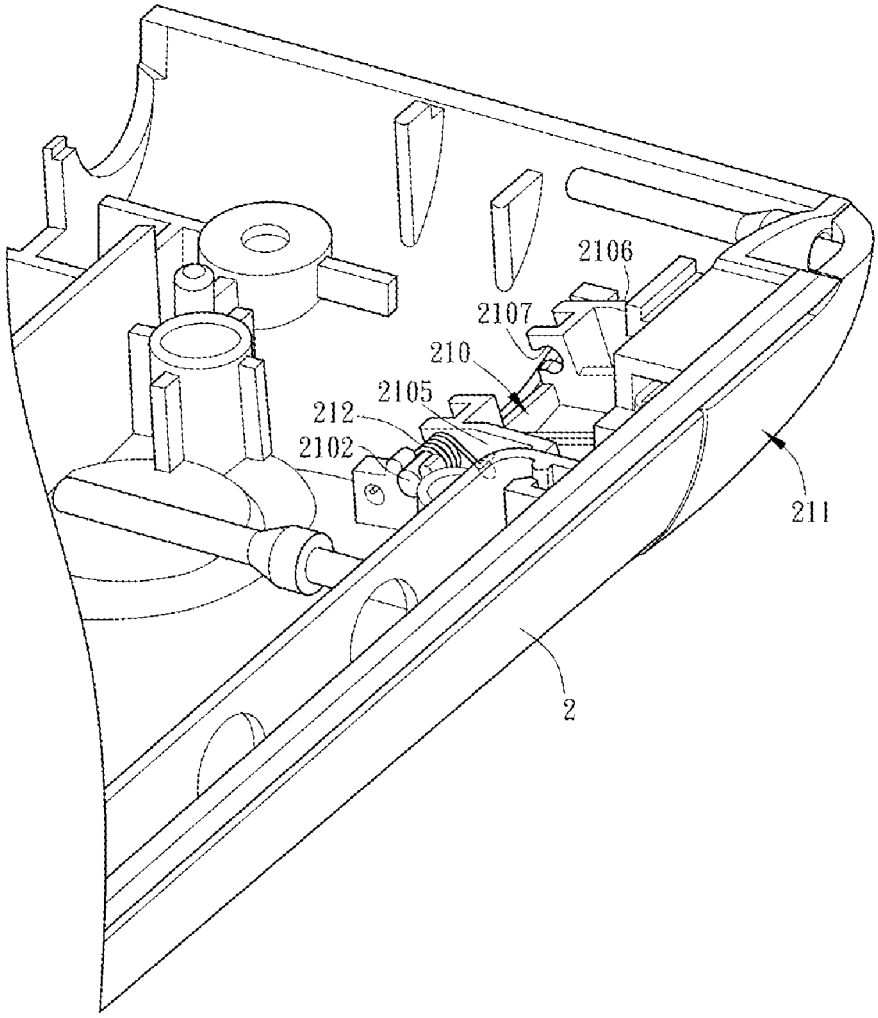
FIG. 3 is an assembled diagram showing a connector socket according to one preferred embodiment of the invention.

FIG. 2 is an exploded schematic diagram showing a connector socket according to one preferred embodiment of the invention. FIG. 3 is an assembled diagram showing a connector socket according to one preferred embodiment of the invention. Please refer to FIG. 2 and FIG. 3 together.

A connector socket 21 according to the embodiment is disposed at an opening 20 of a casing 2 for connecting a connector 3. In the embodiment, the connector socket 21 includes a rotatable element 210, a covering element 211, and a biasing element 212.

In FIG. 2, the rotatable element 210 has a protrudent portion 2101, a connecting shaft 2102, a fastening portion 2103, a first blocking portion 2104, and side walls 2105 and 2106.

In the embodiment, the protrudent portion 2101 is disposed at an outer edge of the rotatable element 210. In the embodiment, the rotatable element 210 is disposed at the lower side of the opening 20, and the protrudent portion 2101 can be disposed to protrude upward. However, the invention is not limited thereto. In other embodiments, when the rotatable element 210 is disposed at the upper side of the opening 20, the protrudent portion 2101 may be disposed to protrude downward.

In the embodiment, when the connector 3 is connected to the connector socket 21 through the opening 20, the bottom of the connector 3 can first contact the protrudent portion 2101. The operation of the protrudent portion 2101 is described in detail hereinbelow.

In the embodiment, the connector socket 21 has the connecting shaft 2102. One end of the connecting shaft 2102 is disposed at the side wall 2105, and the other end of the connecting shaft 2102 can be pivotally connected to the casing 2. The side wall 2106 of the connector socket 21 can have a through hole 2107. The casing 2 has another connecting shaft 23 corresponding to the through hole 2107.

In the embodiment, when the connector 3 contacts the protrudent portion 2101 and exerts pressing force, the connecting shaft 2102 rotates, and the other connecting shaft 23 of the casing 2 also rotates in the through hole 2107, thereby driving the whole rotatable element 210 to rotate relative to the casing 2. However, the invention is not limited thereto. In other embodiments, the connector socket 21 may have two connecting shafts 2102 disposed at the side walls 2105 and 2106, respectively. Otherwise, the two connecting shafts 2102 may also be disposed at the casing 2.

In the embodiment, to ensure a reliable connection between the connector 3 and the connector socket 21, the rotatable element 210 can have the two fastening portions 2103 disposed at two sides adjacent to the protrudent portion 2101, respectively. When the connector 3 is connected to the connector socket 21, the fastening portions 2103 are fastened to the connector 3 at two sides. However, the number and location of the fastening portions 2103 are not limited in the invention. In other embodiments, the fastening portions 2103 may not be needed.

In the embodiment, to provide a better positioning function, the rotatable element 210 has the two first blocking portions 2104 protruding outward from the side walls 2105 and 2106, respectively. Correspondingly, the casing 2 can have second blocking portions 22 corresponding to the first blocking portions 2104, respectively. When the rotatable element 210 rotates downward to a certain angle, the second blocking portions 22 contact the first blocking portions 2104 to limit the rotation thereof, thus to allow the rotatable element to achieve the greatest rotating angle. However, the number and location of the first blocking portions 2104 are not limited in the invention. In other embodiments, the first blocking portions 2104 may not be needed.

In the embodiment, the covering element 211 is pivotally connected to the casing 2 for covering the opening 20. In the embodiment, the covering element 211 includes a rotatable shaft 2110 and a cover 2111. One end of the rotatable shaft 2110 is connected to the casing 2, and the other end of the rotatable shaft 2110 is connected to the cover 2111. The cover 2111 can be used for covering the opening 20. The cover 2111 has a recessed portion 2112 at one side thus to facilitate operating the cover 2111 by a user. In the embodiment, the rotatable shaft 2110 can be made of a soft material.

For example, when the user uses the connector socket 21, the user exerts force onto the recessed portion 2112 to separate the cover 2111 from the opening 20 by a finger and rotates the cover 2111 along an upper right direction by the rotatable shaft 2110, thus to wholly expose the opening 20 for conveniently inserting the connector 3. After use of the connector socket 21 is finished, the cover 2111 can also be rotated by the rotatable shaft 2110 to cover the opening 20. Thus, a dust-proof function can be achieved.

In the embodiment, the biasing element 212 is sleeved on the connecting shaft 2102. As shown in FIG. 3, one end of the biasing element 212 is connected to the side wall 2105 of the rotatable element 210, and the other end is connected to the casing 2. In the embodiment, the biasing element 212 can be a torsional spring. In other embodiments, the biasing element 212 may be other equivalent objects with elasticity or other material memory that serves to return the element to a state or position, wherein this elasticity or memory serves to bias the rotatable element 210 to a storage position. The invention is not limited thereto.

In the embodiment, the connector 3 can be an RJ-type connector, and the connector socket 21 can be a corresponding RJ-type connector socket. However, the invention is not limited thereto. Persons having ordinary skill in the art can know that the spirit of the invention can be applied to any other connector socket.

Figure 4:
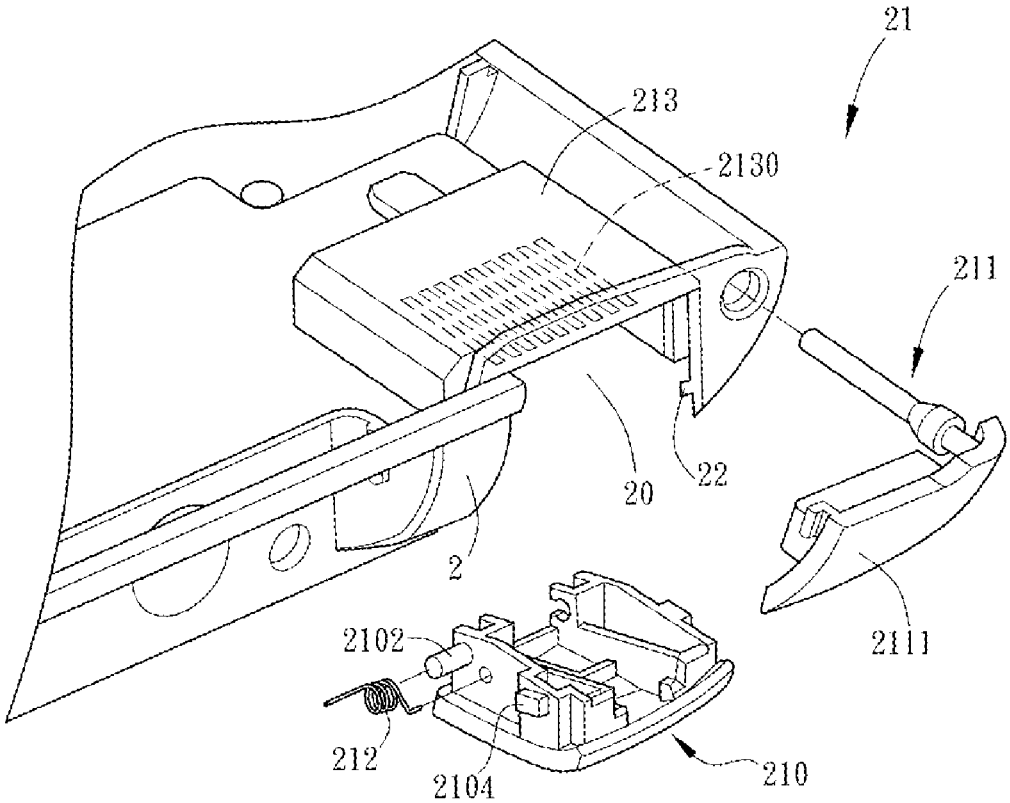
FIG. 4 is an exploded schematic diagram showing a connector socket according to another preferred embodiment of the invention.
Figure 5:
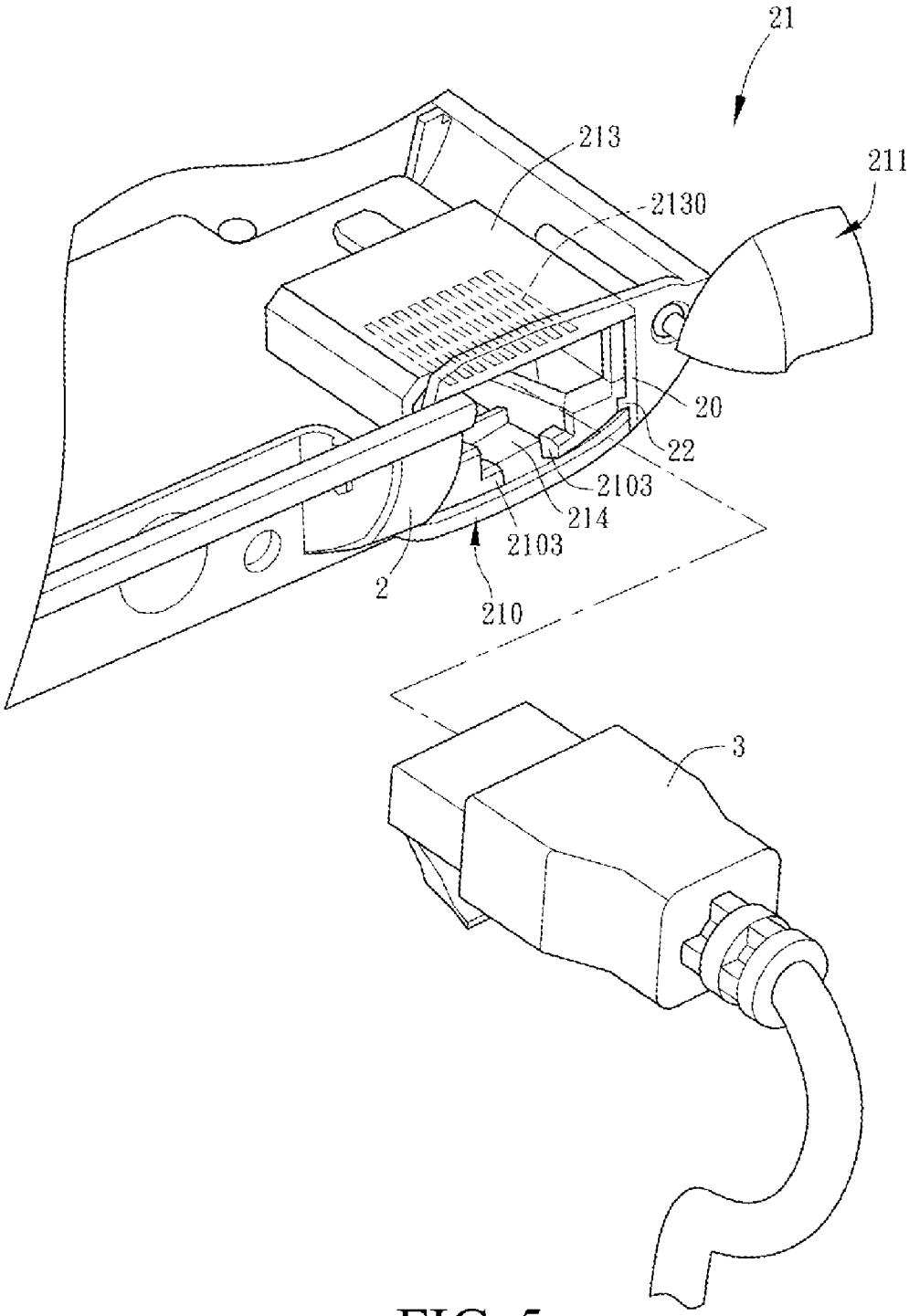
FIG. 5 is an assembled diagram showing a connector socket according to another preferred embodiment of the invention.

FIG. 4 is an exploded schematic diagram showing a connector socket according to another preferred embodiment of the invention. FIG. 5 is an assembled diagram showing a connector socket according to another preferred embodiment of the invention. Please refer to FIG. 4 and FIG. 5 together.

A connector socket 21 according to the embodiment is disposed at an opening 20 of a casing 2 for connecting a connector 3. In the embodiment, the connector socket 21 includes a rotatable element 210, a covering element 211, a biasing element 212, and a connecting element 213.

In the embodiment, the rotatable element 210, the covering element 211, and the biasing element 212 are the same with that in the above embodiment. Therefore, they are not described herein for a concise purpose. Only differences are described hereinbelow.

In the embodiment, the connecting element 213 faces the rotatable element 210. Further, the connecting element 213 includes a plurality of terminals 2130 for electrically connecting the connector 3. In the embodiment, the connecting element 213 is disposed over the rotatable element 210. In other embodiments, the connecting element 213 may also be disposed under the rotatable element 210. The relative position of the rotatable element 210 and the connecting element 213 is not limited in the invention.

Figure 6:
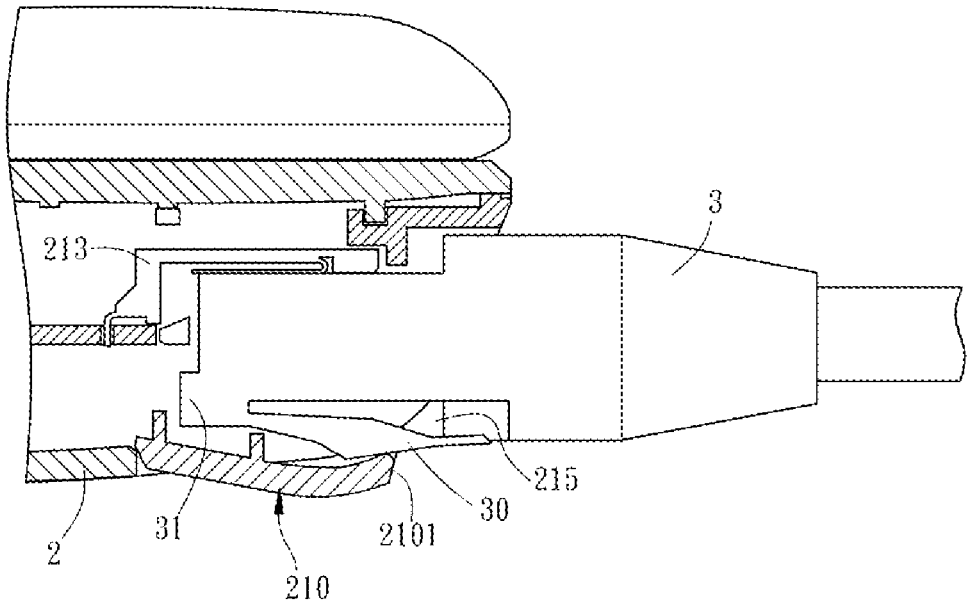
FIG. 6 is a schematic diagram showing a connector socket in operation according to another preferred embodiment of the invention.

FIG. 6 is a schematic diagram showing a connector socket in operation according to another preferred embodiment of the invention. Please refer to FIG. 4, FIG. 5, and FIG. 6 together. In the embodiment, the connector 3 has an elastic sheet 30 and a protrudent edge 31. The protrudent edge 31 is disposed at the lower side of the connector 3 and protrudes from the front end of the connector 3. The elastic sheet 30 can extend backward and downward from the back end of the protrudent edge 31. However, the invention is not limited thereto. In other embodiments, when a protrudent portion 2101 of the rotatable element 210 is disposed to protrude downward, the protrudent edge 31 of the connector 3 may be correspondingly disposed at the upper side of the connector 3.

In the embodiment, when the connector socket 21 is not used, the rotatable element 210 is in a storage position in FIG. 5. At that moment, the connecting element 213 and the rotatable element 210 form a first containing space 214.

In the embodiment, when the connector 3 is to be connected to the connector socket 21, the covering element 211 can be rotated at first to wholly expose the opening 20. When the connector 3 is inserted, since the protrudent edge 31 is disposed at the lower side of the connector 3 and protrudes from the front end of the connector 3, the protrudent edge 31 can first contact the protrudent portion 2101 and exerts pressing force. At that moment, the rotatable element 210 rotates downward relative to the casing 2 by the connecting shaft 2102. Further, with the rotation of the rotatable element 210, the biasing element 212 is elastically deformed.

In the embodiment, when the rotatable element 210 rotates to an open position in FIG. 6, first blocking portions 2104 of the rotatable element 210 contact second blocking portions 22 of the casing 2 and form interference with the second blocking portions 22, thereby limiting the continual downward rotation of the rotatable element 210. At that moment, the connecting element 213 and the rotatable element 210 form a second containing space 215 for containing the connector 3. The volume of the second containing space 215 is greater than that of the first containing space 214 and corresponds to the dimensional standard of the connector 3.

Furthermore, in the embodiment, the protrudent portion 2101 of the rotatable element 210 can press the elastic sheet 30 of the connector 3 to reliably fix the connector 3.

In the embodiment, when the connector 3 is separated from the connector socket 21, the biasing element 212 can release its accumulated elastic potential energy to restore itself to the original state. Thus, the rotatable element 210 can rotate from the open position in FIG. 6 to the storage position in FIG. 5 via the biasing element 212.

At that moment, in the embodiment, the covering element 211 can be rotated to cover the opening 20.

Figure 7:
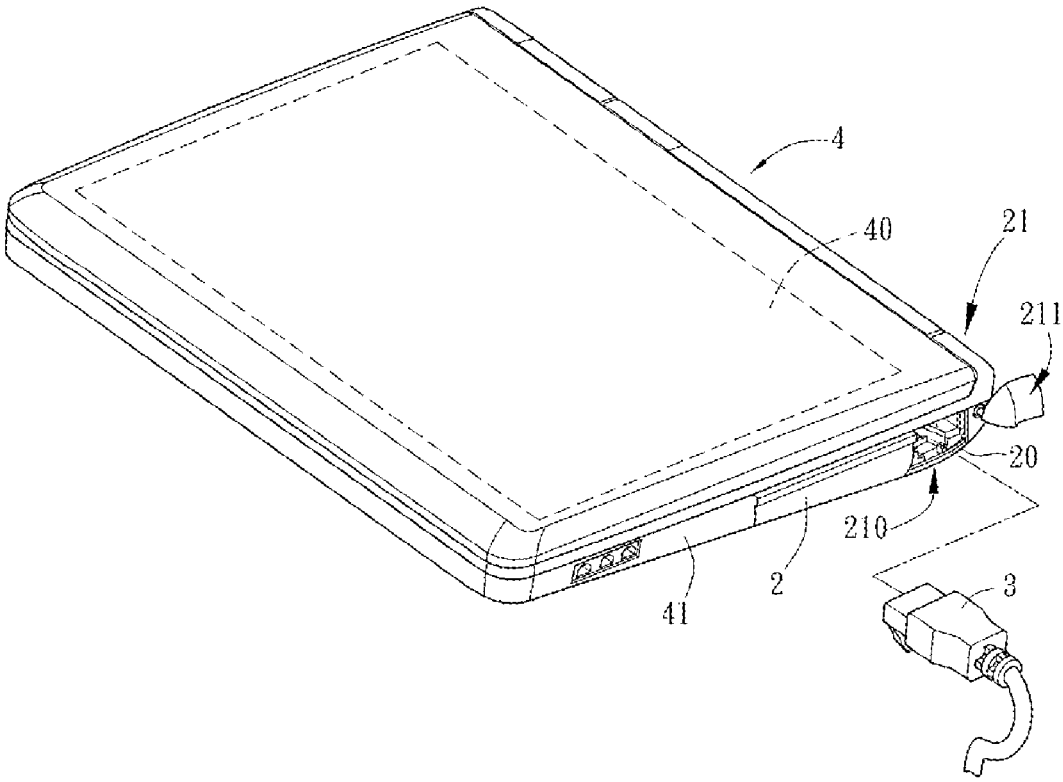
FIG. 7 is a schematic diagram showing a portable electronic device according to one preferred embodiment of the invention.

FIG. 7 is a schematic diagram showing a portable electronic device according to one preferred embodiment of the invention. A portable electronic device 4 according to the embodiment includes a display 40 and a main body 41 for connecting a connector 3. In the embodiment, the portable electronic device 4 can be a notebook computer, and the connector 3 can be an RJ-type connector.

In the embodiment, the main body 41 includes a connector socket 21 and a casing 2. The casing 2 has an opening 20, and the connector socket 21 is disposed at the opening 20.

In the embodiment, the detailed structure of the connector socket 21 is shown in FIG. 2. Therefore, it's not described herein for a concise purpose.

In the embodiment, when the connector 3 is not connected to the connector socket 21, a covering element 211 can cover the opening 20 for achieving a dustproof function. Further, the appearance of the main body 41 has a streamlined effect.

In the embodiment, when the connector 3 is to be connected to the connector socket 21, the covering element 211 can be rotated to wholly expose the opening 20.

In the embodiment, when the connector 3 is inserted, since a rotatable element 210 is pressed by the connector 3, the rotatable element 210 rotates downward from a storage position to an open position and protrudes from the casing 2. At that moment, the connector 3 can be connected to the connector socket 21.

In the embodiment, when the connector 3 is separated from the connector socket 21, the rotatable element 210 can automatically rotates from the open position to the storage position, thereby allowing the main body 41 to present the streamlined appearance. Finally, the covering element 211 can be rotated to cover the opening 20.

To sum up, the connector socket according to the embodiment can reduce the volume thereof. When the connector socket is used, the rotatable element can automatically rotate to the open position or the storage position. In the two positions, the heights of the connector socket are different. Thus, electronic elements can be miniaturized, which meets consumers' needs for the appearance of the portable electronic device and allows the appearance of the portable electronic device to have the streamlined effect. Further, when the connector socket is not used, the covering element can be used for covering the exposed terminals thus to achieve the dustproof function.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A connector socket disposed at a casing for connecting to a connector, the connector socket comprising:

a rotatable element connected to the casing and having a protrudent portion, wherein the rotatable element substantially conforms to an outer contour of the casing; and a biasing element coupled to the casing and the rotatable element, wherein when the connector is connected to the connector socket, the connector presses the protrudent portion to allow the rotatable element to automatically move from a storage position to an open position, thus allowing the rotatable element to protrude from the casing, when the connector is separated from the connector socket, the rotatable element automatically moving from the open position to the storage position via the biasing element, wherein the heights of the connector socket being different in the open position and the storage position.

2. The connector socket according to claim 1, further comprising a connecting element facing the rotatable element, the connecting element including a plurality of terminals for electrically connecting the connector.

3. The connector socket according to claim 2, wherein when the rotatable element is in the storage position, the connecting element and the rotatable element form a first containing space, when the rotatable element is in the open position, the connecting element and the rotatable element form a second containing space, and the first containing space is smaller than the second containing space.

4. The connector socket according to claim 1, further comprising a covering element pivotally connected to the casing, the casing having an opening, the connector socket disposed at the opening, the covering element used for covering the opening.

5. The connector socket according to claim 1, wherein the rotatable element has a connecting shaft rotatably connected to the casing and coupled to the biasing element.

6. The connector socket according to claim 1, wherein the rotatable element has a fastening portion to ensure a reliable connection between the connector and the connector socket, and when the connector is connected to the connector socket, the fastening portion is fastened to the connector.

7. The connector socket according to claim 1, wherein the rotatable element has a first blocking portion disposed at one side of the rotatable element, the casing has a second blocking portion disposed corresponding to the first blocking portion, and when the rotatable element rotates to the open position, the second blocking portion contacts the first blocking portion to limit rotation of the rotatable element.

8. The connector socket according to claim 1, wherein the connector socket is an RJ-type connector socket.

9. A portable electronic device with a connector, comprising:

a casing having an opening; and a connector socket disposed at the opening, including:

a rotatable element connected to the casing and having a protrudent portion, wherein the rotatable element substantially conforms to an outer contour of the casing; and a biasing element coupled to the casing and the rotatable element, wherein when the connector is connected to the connector socket, the connector presses the protrudent portion to allow the rotatable element to automatically move from a storage position to an open position, thus allowing the rotatable element to protrude from the casing, when the connector is separated from the connector socket, the rotatable element automatically moving from the open position to the storage position via the biasing element, wherein the heights of the connector socket being different in the open position and the storage position.

10. The portable electronic device according to claim 9, wherein the connector socket further includes a connecting element facing the rotatable element, and the connecting element includes a plurality of terminals for electrically connecting the connector.

11. The portable electronic device according to claim 10, wherein when the rotatable element is in the storage position, the connecting element and the rotatable element form a first containing space, when the rotatable element is in the open position, the connecting element and the rotatable element form a second containing space, and the first containing space is smaller than the second containing space.

12. The portable electronic device according to claim 9, wherein the connector socket further includes a covering element pivotally connected to the casing for covering the opening.

13. The portable electronic device according to claim 9, wherein the rotatable element has a connecting shaft pivotally connected to the casing and coupled to the biasing element.

14. The portable electronic device according to claim 9, wherein the rotatable element has a fastening portion, and when the connector is connected to the connector socket, the fastening portion is fastened to the connector.

15. The portable electronic device according to claim 9, wherein the rotatable element has a first blocking portion disposed at one side of the rotatable element, the casing has a second blocking portion disposed corresponding to the first blocking portion, and when the rotatable element rotates to the open position, the second blocking portion contacts the first blocking portion to limit rotation of the rotatable element.

16. The portable electronic device according to claim 9, wherein the connector has a protrudent edge, and when the connector is connected to the connector socket, the protrudent edge presses the protrudent portion of the rotatable element.

17. The portable electronic device according to claim 9, wherein the connector socket is an RJ-type connector socket.

* * * * *